US005575155A

United States Patent [19]

Mita et al.

[11] Patent Number: 5,575,155

[45] Date of Patent: Nov. 19, 1996

[54] COOLING SYSTEM

[75] Inventors: Hideo Mita, Okazaki; Katsunobu Kanda, Toyohashi; Hideo Misawa, Anjo; Toshiki Herai, Kokubunji; Ken Nagashima, Hachioji, all of Japan

[73] Assignees: Aisin Seiki Kabushiki Kaisha, Kariya; Railway Technical Research Institute, Tokyo, both of Japan

[21] Appl. No.: 516,364

[22] Filed: Aug. 17, 1995

[30] Foreign Application Priority Data

Aug. 24, 1994 [JP] Japan ..... 6-199403

[51] Int. Cl.[6] ..... F25B 9/00

[52] U.S. Cl. ..... 62/6; 62/608

[58] Field of Search ..... 62/608, 6, 51.1, 62/51.3

[56] References Cited

U.S. PATENT DOCUMENTS

| | | | |
|---|---|---|---|
| 3,914,950 | 10/1975 | Fletcher et al. | 62/608 |
| 4,077,231 | 3/1978 | Fletcher et al. | 62/608 |
| 4,827,736 | 5/1989 | Miura et al. | 62/6 X |
| 4,845,953 | 7/1989 | Misawa et al. . | |
| 5,088,289 | 2/1992 | Mita et al. . | |
| 5,101,635 | 4/1992 | Mita et al. . | |
| 5,317,878 | 6/1994 | Bradshaw et al. | 62/6 |

FOREIGN PATENT DOCUMENTS

| | | | |
|---|---|---|---|
| 1512747 | 1/1968 | France | 62/6 |
| 45-27634 | 9/1970 | Japan . | |
| 0137163 | 5/1989 | Japan | 62/6 |
| 0085653 | 3/1990 | Japan | 62/6 |
| 2110280 | 4/1990 | Japan | 62/6 |
| 0275260 | 11/1990 | Japan | 62/6 |
| 4052467 | 2/1992 | Japan | 62/6 |
| 5099565 | 4/1993 | Japan | 62/51.3 |
| 6513118 | 4/1967 | Netherlands | 62/6 |
| 0992950 | 1/1983 | U.S.S.R. | 62/6 |
| 1451483 | 1/1989 | U.S.S.R. | 62/6 |

*Primary Examiner*—Christopher Kilner

*Attorney, Agent, or Firm*—Oblon, Spivak, McClelland, Maier & Neustadt, P.C.

[57] ABSTRACT

A cooling system includes a cold-accumulating refrigerator, and a cooling circuit. The cold-accumulating refrigerator includes a regenerator. The cooling circuit includes a main circuit, and a branched circuit. The main circuit includes a counterflow heat exchanger. The branched circuit is branched from an upstream portion of the main circuit, and joined to a downstream portion thereof, thereby reducing one of the flows of a refrigerant, flowing in a high-pressure-side passage and a low-pressure-side passage which are disposed in the counterflow heat exchanger, with respect to the other one of the flows. Moreover, the branched circuit includes a heat exchanger, and the heat exchanger is thermally brought into contact with a portion of the regenerator whose temperature is varied from a high temperature to a low temperature by another refrigerant flowing therein. Thus, the cooling efficiency of the cooling system is remarkably improved synergetically by the cooling resulting from the flow-difference in the counterflow heat exchanger, and by the extra cooling stemming from the thermal-contact at the regenerator.

13 Claims, 5 Drawing Sheets

( PRIOR ART )

COOLING SYSTEM

BACKGROUND OF THE INVENTION

1. Field of the Invention

The present invention relates to a cooling system for cooling a substance to be cooled.

2. Description of Related Art

Japanese Examined Patent Publication (KOKOKU) No. 45-27,634 discloses a conventional cooling system which is constructed as illustrated in FIG. 5. As illustrated in FIG. 5, this conventional cooling system comprises a cold gas refrigerator 101 which operates under reverse Stirling cycle, and a cooling circuit 120 for delivering cold to a substance 110 to be cooled.

The cold gas refrigerator (hereinafter simply referred to as "refrigerator") 101 includes a cylinder 100, a piston 102 which reciprocates in the cylinder 100, a displacer 103 which reciprocates with a predetermined phase difference with respect to the piston 102, a chiller 106 which communicates with a compression chamber 104 disposed between the piston 102 and the displacer 103, a freezer 108 which is disposed in an expansion chamber 105 placed between the displacer 103 and a top end of the cylinder 101, and a regenerator 107 which is disposed between the chiller 106 and the expansion chamber 105.

The cooling circuit 120 includes a compressor 121, a piping 124, and a counterflow heat exchanger 123 which is disposed between the piping 124 and the compressor 121. The piping 124 includes a plurality of heat exchangers 125 for conducting cold, and a plurality of heat exchangers 126 for cooling a substance 110 to be cooled. The heat exchangers 125 are thermally brought into contact with the freezer 108. The heat exchangers 125 and the heat exchangers 126 are disposed alternately in series.

In the thus constructed conventional cooling system, the piston 102 compresses a working medium to produce heat in the compression chamber 104 of the refrigerator 101 (i.e., isothermal compression). Then, the displacer 103 moves toward the piston 102 to cool and pass the working medium through the regenerator 107 (i.e., constant-volume cooling). Further, the piston 102 retracts to produce cold in the expansion chamber 105 (i.e., isothermal expansion), and the cold is absorbed by the other working medium which flows in the cold-conducting heat exchanger 125 being thermally brought into contact with the freezer 108. Furthermore, the displacer 103 moves to its top dead center, and thereby the working medium cools the regenerator 107 and returns to the compression chamber 104 (i.e., constant-volume heating).

The other working medium flows in the cooling circuit 120. When it flows in the cold-conducting heat exchanger 125, its heat is absorbed, and cold thus produced is conducted to the heat exchanger 126 for cooling. Accordingly, the substance 110 to be cooled is cooled. The counterflow heat exchanger 123 cools the high-pressure working medium, which is delivered from the compressor 121, by means of the low-pressure working medium which returns to the compressor 121.

The thus constructed cooling system can employ a helium gas as the working media, and can be applied to home-use refrigerators, air conditioners, etc. When its refrigerator employs a multi-staged expansion arrangement, and when its cooling circuit utilizes a Joule-Thomson (hereinafter referred to as "J-T") circuit, it is possible to attain a liquefied helium temperature as low as 4.2K, and to cool superconducting magnets.

In the counterflow heat exchanger 123 of the thus constructed cooling system, its low-pressure-side passage **123*b* is connected to an inlet port of the compressor 121, and its high-pressure-side passage 123*a* is connected to an outlet port of the compressor 121. The flow of the other working medium flowing in the low-pressure-side passage 123*b* is equal to the flow of the other working medium flowing in the high-pressure-side passage 123*a*. Accordingly, in the counterflow heat exchanger 123**, the heat exchange is carried out in an averaged manner.

If the flow in the low-pressure-side passage **123*b* could be set larger than that of the flow in the high-pressure-side passage 123*a*, the other working medium of high-temperature flowing in the high-pressure-side passage 123*a* could be cooled by the other working medium of low-temperature flowing in the low-pressure-side passage 123*b* with enhanced cooling efficiency. As a result, it is assumed that the temperature of the other working medium of high-pressure prior to flowing into the cold-conducting heat exchanger 125 could be reduced considerably, and that the cold-conducting heat exchanger 125** could be enhanced accordingly in terms of Carnot efficiency.

Hence, in order to set the flow in the low-pressure-side passage **123*b* larger than the flow in the high-pressure-side passage 123*a*, one may think of branching part of the other working medium flowing into the high-pressure-side passage 123*a***.

However, the flow in the low-pressure-side passage **123*b* should eventually be identical with the flow in the high-pressure-side passage 123*a*. In other words, the flow should be equal on the outlet-port side and the inlet-port side of the compressor 121. Consequently, it is needed to join the branched flow with the working medium which has been flowed in the high-pressure-side passage 123*a* downstream with respect to the counterflow heat exchanger 123. If such the case, the cooling efficiency in the cold-conducting heat exchangers 125 is degraded sharply, because the branched working medium is not cooled by the counterflow heat exchanger 123. Accordingly, in spite of the enhanced cooling efficiency in the counterflow heat exchanger 123, there arises a problem in that the substance 110** to be cooled cannot be cooled with improved cooling capability.

SUMMARY OF THE INVENTION

It is therefore an object of the present invention to provide a cooling system in which part of a working medium flowing in a high-pressure-side passage of a counterflow heat exchanger is branched so as to reduce the flow therein to less than a flow in a low-pressure-side passage thereof, thereby enhancing a cooling efficiency in the counterflow heat exchanger, in which part of the working medium thus branched is cooled favorably from the viewpoint of Carnot efficiency, and whose capability of cooling a substance to be cooled is remarkably improved accordingly.

In a first aspect of the present invention, a cooling system comprises:

- a cold-accumulating refrigerator including:
  - a compression chamber in which a first refrigerant is compressed;
  - a chiller for dissipating heat resulting from the compression of the first refrigerant;
  - a regenerator communicating with the chiller; and an expansion chamber in which the first refrigerant, transferred via the regenerator, is expanded; and a cooling circuit in which a second refrigerant flows, the cooling circuit including a main circuit and a branched circuit:

the main circuit including:

pressure delivering means having an inlet port and an outlet port;

a heat exchanger for cooling a substance to be cooled;

a high-pressure-side circuit connecting the outlet port of the pressure delivering means and the cooling heat exchanger;

a low-pressure-side circuit connecting the cooling heat exchanger and the inlet port of the pressure delivering means; and a counterflow heat exchanger for thermally bringing the second refrigerant, flowing in the high-pressure-side circuit, into contact with the second refrigerant, flowing in the low-pressure-side circuit; and the branched circuit for branching part of the second refrigerant from an upstream portion, which is placed between the pressure delivering means and the counterflow heat exchanger in the high-pressure-side circuit of the main circuit, and introducing the part of the second refrigerant into a downstream portion, which is placed between the counterflow heat exchanger and the cooling heat exchanger in at least one of the high-pressure-side circuit and the low-pressure-side circuit of the main circuit, the branched circuit including:

a heat exchanger for conducting cold, the cold-conducting heat exchanger being thermally brought into contact with a portion of the regenerator of said cold-accumulating refrigerator whose temperature is varied from a high temperature to a low temperature by the first refrigerant flowing therein.

In the first aspect of the present invention, the second refrigerant delivered out of the pressure delivering means is divided into a portion which is directed to flow into the counterflow heat exchanger of the main circuit, and the other portion which is directed to flow into the cold-conducting heat exchanger of the branched circuit. The other portion of the second refrigerant delivered through the cold-conducting heat exchanger is joined with the second refrigerant flowing in at least one of the high-pressure-side circuit and the low-pressure-side circuit which is placed downstream with respect to the counterflow heat exchanger. As a result, when comparing the flows of the second refrigerant counterflowing in the counterflow heat exchanger, specifically, when comparing the flow of the second refrigerant flowing in the low-pressure-side circuit disposed in the counterflow heat exchanger with the flow of the second refrigerant flowing in the high-pressure-side circuit disposed therein, the flow in the low-pressure-side circuit is larger than the flow in the high-pressure-side circuit. Therefore, it is possible to enhance the cooling efficiency in the counterflow heat exchanger, in other words, to improve the efficiency for cooling the second refrigerant flowing in the high-pressure-side circuit disposed in the counterflow heat exchanger.

Moreover, the cold-conducting heat exchanger of the branched circuit is thermally brought into contact with a portion of the regenerator of the cold-accumulating refrigerator whose temperature is varied from a high temperature to a low temperature by the first refrigerant flowing therein. Accordingly, in the order of from a high temperature to a low temperature, the high-pressure and high-temperature second refrigerant delivered out of the pressure delivering means can be subjected to heat exchange with the first refrigerant. Considering this heat exchange from the viewpoint of Carnot efficiency, the second refrigerant is continuously subjected to heat exchange with the high-temperature first refrigerant which has a reduced temperature difference with respect to the second refrigerant. Thus, it is possible to favorably enlarge the cooling efficiency.

All in all, the part of the high-pressure second refrigerant, which is branched from the counterflow heat exchanger, is cooled efficiently by the cold-conducting heat exchanger. Moreover, the temperature of the second refrigerant flowing in the high-pressure-side circuit disposed in the counterflow heat exchanger is furthermore reduced by the second refrigerant flowing in the low-pressure-side circuit disposed therein. The synergetic advantageous effect resulting from these operations can remarkably enhance the present cooling system in terms of cooling capability for cooling the substance to be cooled.

In accordance with the first aspect of the present invention, the second refrigerant discharged out of the pressure delivering means is divided into a portion which is directed to flow into the counterflow heat exchanger of the main circuit, and the other portion which is directed to flow into the cold-conducting heat exchanger of the branched circuit. The latter portion of the second refrigerant is again joined with the second refrigerant flowing in at least one of the high-pressure-side circuit and the low-pressure-side circuit which are disposed in the counterflow heat exchanger on a downstream side of the main circuit, and it is further cooled by the cold-conducting heat exchanger of the cold-accumulating refrigerator. Thus, not only the latter portion of the second refrigerant can be cooled efficiently by the cold-conducting heat exchanger, but also it can be cooled with improved cooling efficiency which stems from the flow difference between the high-pressure-side circuit and the low-pressure-side circuit which are disposed in the counterflow heat exchanger of the main circuit. Because of the synergetic advantageous effect, the substance to be cooled can be cooled by the present cooling system with remarkably enhanced cooling capability.

In a second aspect of the present invention, a cooling system comprises:

a cold-accumulating refrigerator as set forth in the first aspect of the present invention; and a cooling circuit in which a second refrigerant flows, the cooling circuit including a main circuit and a branched circuit:

the main circuit including:

pressure delivering means having an inlet port and an outlet port;

cooling means for cooling a substance to be cooled;

a high-pressure-side circuit connecting the outlet port of the pressure delivering means and the cooling means;

a low-pressure-side circuit connecting the cooling means and the inlet port of the pressure delivering means;

a first counterflow heat exchanger for thermally bringing the second refrigerant, flowing in the high-pressure-side circuit, into contact with the second refrigerant, flowing in the low-pressure-side circuit;

a second counterflow heat exchanger for thermally bringing the second refrigerant, flowing in the high-pressure-side circuit downstream with respect to the first counterflow heat exchanger, into contact with the second refrigerant, flowing in the low-pressure-side circuit upstream with respect to the first counterflow heat exchanger; and a Joule-Thomson valve disposed between the second counterflow heat exchanger and the cooling means in a boundary between the high-pressure-side circuit and the low-pressure-side circuit; and the branched circuit for branching part of the second refrigerant from an upstream portion, which is placed between the pressure delivering means and the first counterflow heat exchanger in the high-pressure-side circuit of the main circuit, and introducing the part of the second refrigerant into a downstream portion, which is placed between the first counterflow heat exchanger and the cooling means, in at least one of the high-pressure-side circuit and the low-pressure-side circuit of the main circuit, the branched circuit including:

a heat exchanger for conducting cold, the cold-conducting heat exchanger being thermally brought into contact with a portion of the regenerator of said cold-accumulating refrigerator whose temperature is varied from a high temperature to a low temperature by the first refrigerant flowing therein.

In the second aspect of the present invention, the first aspect of the present invention is applied to a Joule-Thomson circuit. Specifically, the second refrigerant counterflows in the first counterflow heat exchanger, the flow of the second refrigerant flowing in the low-pressure-side circuit disposed in the first counterflow heat exchanger is greater than the flow of the second refrigerant flowing in the high-pressure-side circuit disposed therein, and thereby the cooling efficiency is enlarged in the first counterflow heat exchanger. The second refrigerant thus cooled by the first counterflow heat exchanger is further cooled by the second counterflow heat exchanger, and then it is supplied to the Joule-Thomson valve. Thus, in the second aspect of the present invention, the present cooling system can be improved in terms of the cooling capability for cooling the substance to be cooled, and simultaneously it can be upgraded in terms of the yield of the liquefied second refrigerant.

In accordance with the second aspect of the present invention, the cooling capability of the present cooling system for cooling the substance to be cooled can be improved by the operations similar to those of the first aspect of the present invention. Moreover, when the present cooling system is utilized as a liquefying apparatus, the yield of the liquefied second refrigerant can be enlarged.

Note that, in the second aspect of the present invention, the cooling means can be a liquid reservoir for holding a liquid (e.g., the second refrigerant liquefied by the Joule-Thomson valve) therein, or a heat exchanger for cooling.

A third aspect of the present invention is characterized in that a flow ratio of the part of the second refrigerant, branching from the upstream portion of the high-pressure-side circuit, with respect to the rest of the second refrigerant, flowing only in the main circuit, is set so as to fall in a range of from a finite number, being more than zero, to 0.3.

In the third aspect of the present invention, by setting the flow ratio as aforementioned, the temperature of the part of the second refrigerant, branching from the upstream portion of the high-pressure-side circuit and coming out of the counterflow heat exchanger, is reduced to less than that of the rest of second refrigerant at the downstream portion where the part of the second refrigerant joins with the rest of the second refrigerant flowing in the high-pressure-side circuit or the low-pressure-side circuit of the main circuit. As a result, it is possible to furthermore enhance the cooling-efficiency improvement effect produced by the first or second aspect of the present invention.

In accordance with the third aspect of the present invention, the flow ratio of the part of the second refrigerant, branching from the upstream portion of the high-pressure-side circuit and coming out of the counterflow heat exchanger, with respect to the rest of the second refrigerant, flowing only in the main circuit, is set so that the temperature of the part of the second refrigerant is reduced to less than that of the rest of the second refrigerant at the downstream portion where the part of the second refrigerant joins with the rest of the second refrigerant flowing in the high-pressure-side circuit or the low-pressure-side circuit of the main circuit. The cooling-efficiency improvement effect produced by the first or second aspect of the present invention can be upgraded remarkably.

In the present invention, the cold-accumulating refrigerator can be a Stirling refrigerator, a Gifford-McMahon refrigerator, a Solvay refrigerator, a Willmayer refrigerator, a pulse pipe refrigerator, etc.

In the present invention, the cooling circuit can be a refrigerant circuit for air-conditioners or refrigerators, or a Joule-Thomson circuit capable of generating liquid helium and cooling superconducting magnets.

In the present invention, the pressure delivering means can be a compressor, a pump or a blower.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

Figure 1:
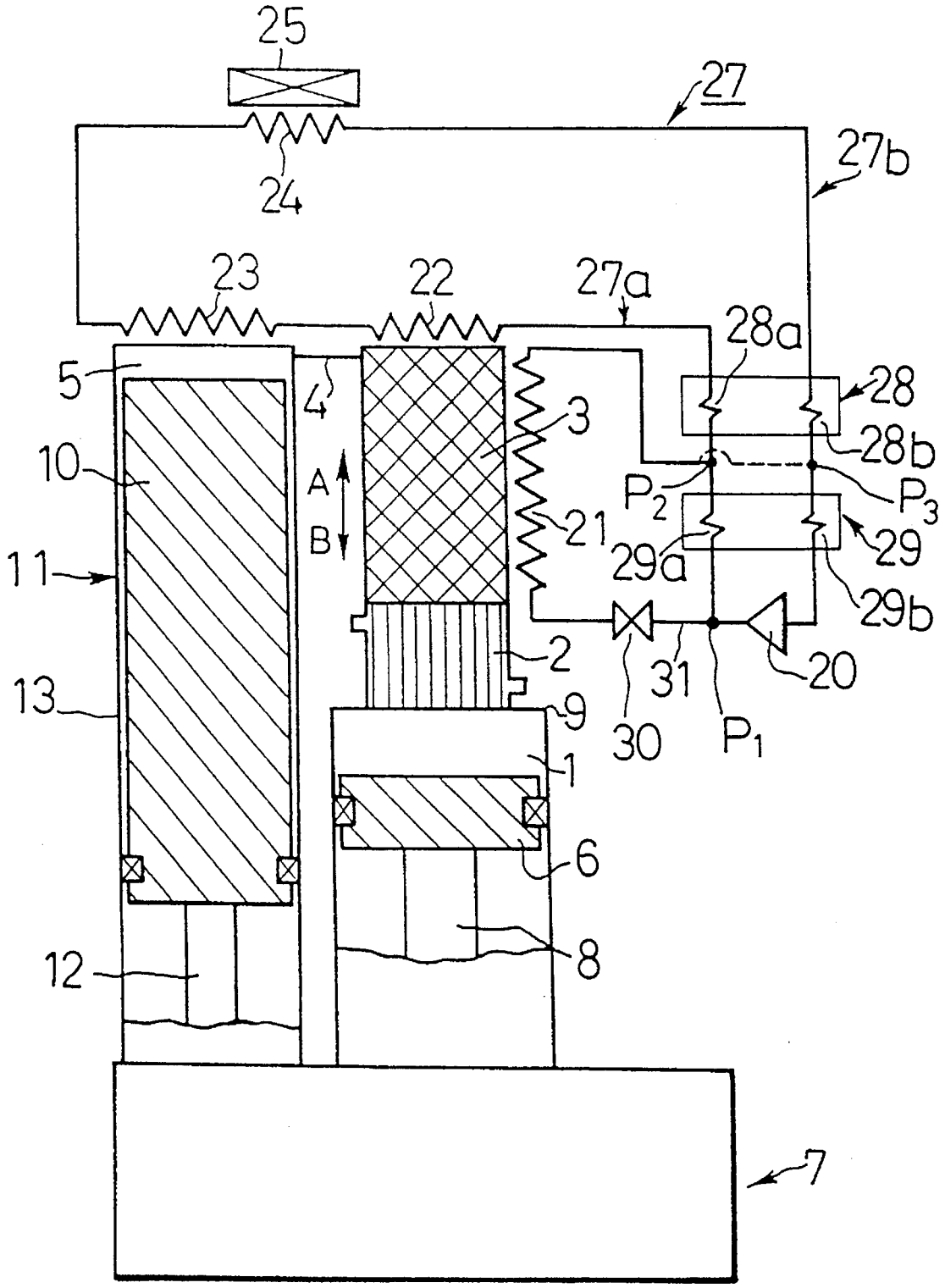
FIG. 1 is a circuit diagram of a First Preferred Embodiment of a cooling system which embodies the first aspect of the present invention.

FIG. 1 is a circuit diagram of a First Preferred Embodiment of a cooling system which embodies the first aspect of the present invention. As illustrated in FIG. 1, this cooling system comprises a single-motion and double-piston type refrigerator 11, and a cooling circuit 27 for cooling a substance 25 to be cooled.

The single-motion and double-piston type refrigerator 11 includes a compression cylinder 9 into which a piston 6 is fitted, an expansion cylinder 13 into which a piston 10 is fitted, a water-cooling chiller 2 which communicates with a compression chamber 1 in the compression cylinder 9, a regenerator 3 which communicates with the chiller 2, and a pipe 4 which communicates the regenerator 3 with an expansion chamber 5 in the expansion cylinder 13. The piston 6 disposed in the compression cylinder 9 and the piston 10 disposed in the expansion cylinder 13 are driven via rods 8, 12 by a power-driving apparatus 7 which, for instance, includes a crank mechanism and a motor. The power-driving apparatus 7 reciprocates the pistons 6, 10 at a predetermined relative phase difference, for example, at a phase difference of 90°.

The cooling circuit 27 includes pressure delivering means 20 which can be a compressor, a pump, etc., and a main circuit for flowing a second refrigerant between the pressure delivering means 20 and a heat exchanger 24 for cooling the substance 25 to be cooled. A high-pressure-side circuit 27*a* is constituted by a passage of the second refrigerant which begins at an outlet port of the pressure delivering means 20 and leads to the cooling heat exchanger 24. A low-pressure-side circuit 27*b* is constituted by a passage of the second refrigerant which begins at the cooling heat exchanger 24 and leads to an inlet port of the pressure delivering means 20.

The high-pressure-side circuit 27*a* and the low-pressure-side circuit 27*b* are combined parallelly by counterflow heat exchangers 28, 29 (i.e., the counterflow heat exchanger in the first aspect of the present invention). In a counterflow mode, the counterflow heat exchangers 28, 29 thermally bring the second refrigerant flowing out of the outlet port of the pressure delivering means 20 with the second refrigerant flowing into the inlet port of the pressure delivering means 20. The high-pressure-side circuit 28*a*, which is disposed in the counterflow heat exchanger 28, is further connected to a pre-cooling heat exchanger 22 which is thermally brought into contact with a low-temperature end of the regenerator 3. The pre-cooling heat exchanger 22 is then connected to a pre-cooling heat exchanger 23 which is thermally brought into contact with a low-temperature end of the expansion chamber 5. Thus, the pre-cooling heat exchanger 23 directly conducts cold to the cooling heat exchanger 24.

The thus constructed First Preferred Embodiment is characterized in that a branched circuit 31 is disposed in the cooling circuit 27. The branched circuit 31 is branched at a branching point $P_1$ which is placed between the outlet port of the pressure delivering means 20 and the counterflow heat exchanger 29, and it is joined with the high-pressure-side circuit 27*a* at a joining point $P_2$ which is placed between the counterflow heat exchangers 28, 29. Specifically, the branched circuit 31 is provided with a throttle 30 and a distributor heat exchanger 21, and it is disposed parallelly with a high-pressure-side passage 29*a* which is disposed in the counterflow heat exchanger 29. The throttle 30 regulates a flow of the second refrigerant flowing into the high-pressure-side circuit 27*a* on the downstream side with respect to the high-pressure-side passage 29*a* which is disposed in the counterflow heat exchanger 29. The distributor heat exchanger 21 thermally brings the second refrigerant, which is delivered via the throttle 30, into contact with a portion of the could-accumulator 3 whose temperature is varied from a high temperature to a low temperature by the first refrigerant flowing therein.

The operations of the thus constructed cooling system will be hereinafter described. The piston 6 of the compression cylinder 9 compresses the first refrigerant with the retarded 90° phase difference with respect to the piston 10 of the expansion cylinder 13. When the piston 6 compresses the first refrigerant, the first refrigerant is heated to about 300K in the compression chamber 1, and cooled to room temperature substantially while it passes through the chiller 2. When the first refrigerant passes through the regenerator 3, it is cooled gradually to low temperature by a cold-accumulating member disposed therein in the direction of its flow designated at the arrow "A" of the FIG. 1. Further, the first refrigerant passes through the pipe 4, and flows into the expansion chamber 5. Then, the piston 10 is operated to expand the expansion chamber 5, and accordingly cold of further lower temperature is produced in the expansion chamber 5. Thereafter, the piston 10 is operated to contract the expansion chamber 5, and the first refrigerant flows back into the compression chamber 1 in the direction designated at the arrow "B" of FIG. 1. Thus, one cooling cycle is completed in the refrigerator 11.

The second refrigerant flowing in the cooling circuit 27 is compressed by the pressure delivering means 20, and delivered out of its outlet port. Then, the second refrigerant is divided into a flow flowing into the branched circuit 31, and the other flow flowing into the high-pressure-side passage 29*a* which is disposed in the counterflow heat exchanger 29. In the high-pressure-side passage 29*a*, the latter flow of the second refrigerant, flowing into the high-pressure-side passage 29*a* disposed in the counterflow heat exchanger 29, is cooled by the second refrigerant flowing in the low-pressure-side passage 29*b* disposed therein. The former flow of the second refrigerant, flowing into the branched circuit 31, is flowed into the distributor heat exchanger 21 via the throttle 30, and is thermally brought into contact with a portion of the regenerator 3 whose temperature is varied from a high temperature to a low temperature by the first refrigerant flowing therein. Thus, the former flow of the second refrigerant is cooled by being thermally brought into contact with the first refrigerant which is reciprocated in the regenerator 3 and whose temperature is varied from a high temperature to a low temperature.

At the joining point $P_2$, the flow of the second refrigerant cooled by the distributor heat exchanger 21 is joined to the flow of the second refrigerant coming from the high-pressure-side passage 29*a* which is disposed in the counterflow heat exchanger 29. Thereafter, the thus joined flow is flowed into the high-pressure-side passage 28*a* which is disposed in the counterflow heat exchanger 28, and is cooled by the low-pressure-side passage 29*b* which is disposed therein.

Further, in the pre-cooling heat exchanger 22, the flow of the second refrigerant, flowed through the high-pressure-side passage 28*a* disposed in the counterflow heat exchanger 28, is further cooled by the low-temperature end of the regenerator 3 which works as a cold source. Subsequently, in the pre-cooling heat exchanger 23, it is furthermore cooled by the low-temperature end of the expansion chamber 5 which works as another cold source.

The thus cooled second refrigerant is delivered to the cooling heat exchanger 24 by the action of the pressure delivering means 20. In the heat exchanger 24, its cold is conducted to the substance 25 to be cooled, and it is then returned to the low-pressure-side passage 28*b* which is disposed in the counterflow heat exchanger 28.

The above-described behavior of the second refrigerant is summarized as follows; namely: the second refrigerant discharged out of the pressure delivering means 20 is divided into the flow going into the high-pressure-side passage 29*a* which is disposed in the counterflow heat exchanger 29 of the main circuit 32, and the other flow going into the cold-conducting heat exchanger 21 of the branched circuit 31. As a result, it is possible to set the flow of the second refrigerant flowing in the low-pressure-side passage 29*b*, which is disposed in the counterflow heat exchanger 29, greater than the flow of the second refrigerant flowing in the high-pressure-side passage 29*a*, which is disposed therein, and accordingly it is possible to upgrade the cooling efficiency in the counterflow heat exchanger 29.

In addition, in the distributor heat exchanger 21, the other flow of the second refrigerant is thermally brought into contact with a portion of the regenerator 3 whose temperature is varied from a high temperature to a low temperature by the first refrigerant flowing therein. As a result, it is possible for the second refrigerant of high-pressure and high-temperature, which is discharged to the branched circuit 31 by the pressure delivering means 20 to continuously carry out heat exchange with the first refrigerant in the order of from a high temperature to a low temperature. Considering this continuous heat exchange from the perspective of the Carnot efficiency, the second refrigerant is continuously subjected to heat exchange with the high-temperature first refrigerant which has a reduced temperature difference with respect to the second refrigerant. Thus, the cooling efficiency can be favorably enhanced in the branched circuit 31.

Even when the high-pressure second refrigerant, discharged just out of the pressure delivering means 20, is divided into a part flowing into the counterflow heat exchanger 29 of the main circuit 32, and the other part flowing into the branched circuit 31, the latter part of the second refrigerant is cooled efficiently in the distributor heat exchanger 21. Because the flow of the second refrigerant flowing into the counterflow heat exchanger 29 is thus reduced, the temperature of the second refrigerant, flowing in the high-pressure-side passage 29*a* disposed in the counterflow heat exchanger 29, is further decreased by the second refrigerant of increased flow, flowing in the low-pressure-side passage 29*b* disposed therein. All in all, the thus constructed cooling system can be improved sharply in terms of capability for cooling the substance 25 to be cooled.

Modified Version of the First Preferred Embodiment

In the First Preferred Embodiment, the branched circuit 31 is branched from the branching point $P_1$ of the main circuit 32, and is joined to the joining point $P_2$ thereof. However, note that, as specified by the dotted line of FIG. 1, the branched circuit 31 can be branched from the branching point $P_1$ (e.g., the outlet port of the pressure delivering means 20) of the main circuit 32, and can be joined to a joining point $P_3$ thereof (e.g., a connecting point between the low-pressure-side passage 28*b* which is disposed in the counterflow heat exchanger 28, and the low-pressure-side passage 29*b* which is disposed in the counterflow heat exchanger 29).

If such is the case, the second refrigerant discharged out of the branched circuit 31 is joined with the flow of the second refrigerant flowing in the low-pressure-side passage 28*b* which is disposed in the counterflow heat exchanger 28. The thus joined flow of the second refrigerant is then flowed into the low-pressure-side passage 29*b* which is disposed in the counterflow heat exchanger 29. Part of the joined flow is again discharged to the high-pressure-side passage 29*b* disposed in the counterflow heat exchanger 29 by way of the pressure delivering means 20.

In the thus constructed modified version, the flow of the second refrigerant flowing in the low-pressure-side passage 29*b*, which is disposed in the counterflow heat exchanger 29, is greater than the flow of the second refrigerant flowing in the high-pressure-side passage 29*a*, which is disposed therein. Moreover, the second refrigerant flowing in the high-pressure-side passage 29*a*, which is disposed in the counterflow heat exchanger 29, can be also cooled efficiently by the branched second refrigerant which has been cooled by the distributor heat exchanger 21 and flows into the low-pressure-side passage 29*b*.

Figure 2:
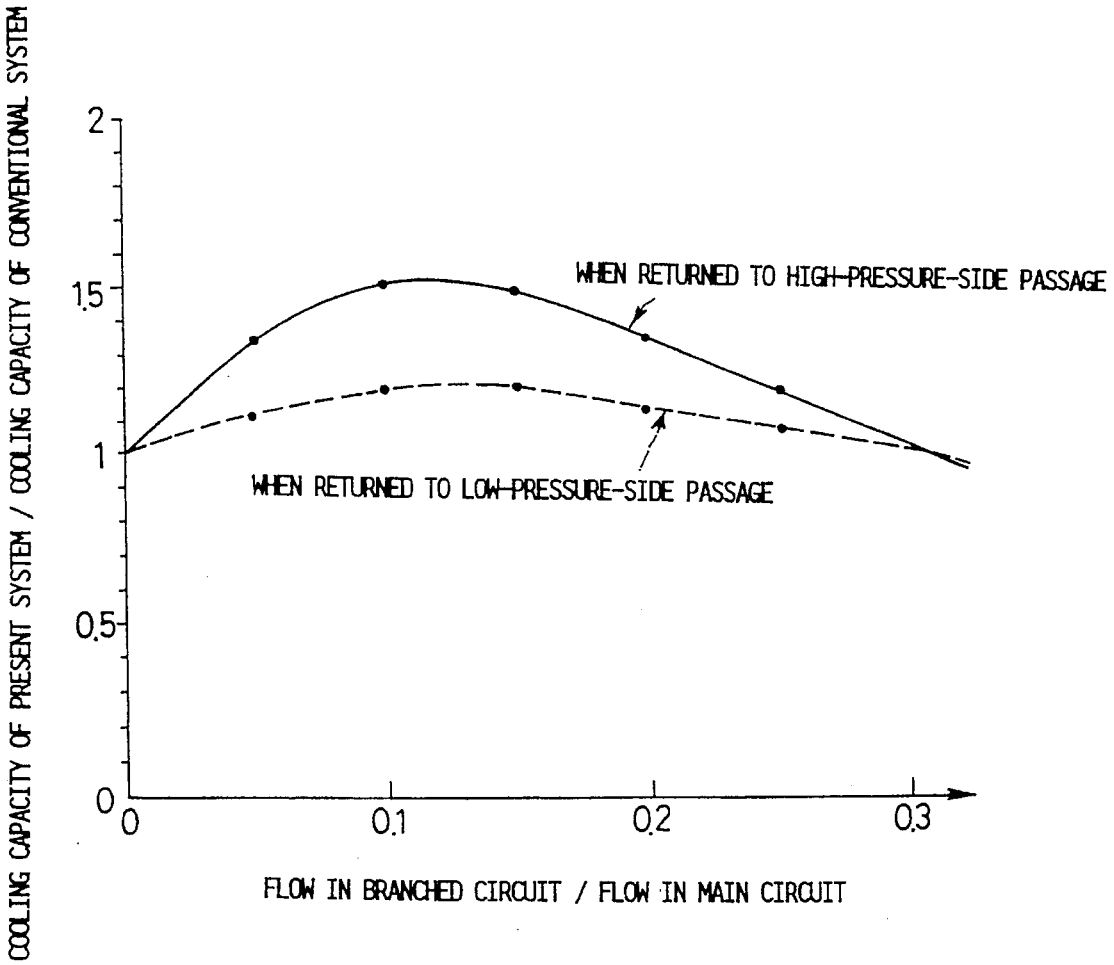
FIG. 2 is a graph illustrating characteristic curves which verify that cooling-capacity is improved by the First Preferred Embodiment.

However, as illustrated in FIG. 2, it was verified that the cooling capability was improved less than the case where the branched circuit 31 was joined with the high-pressure-side passage 29*a* of the main circuit 32 at the joining point $P_2$. This phenomenon is assumed to result from the fact that, when cold is conducted from the low-pressure-side passage 29*b* to the high-pressure-side passage 29*a* in the counterflow heat exchanger 29, the refrigeration of the second refrigerant cooled by the distributor heat exchanger 21 cannot be conducted completely.

FIG. 2 is a graph illustrating the cooling-capacity characteristic curves which were exhibited by the First Preferred Embodiment and the modified version thereof. In FIG. 2, the horizontal axis specifies the flow ratio of the branched circuit 31 to the main circuit 32 (e.g., the flow in the branched circuit 31/the flow in the main circuit 32), and the vertical axis specifies the cooling capacities of the First Preferred Embodiment and the modified version thereof which are normalized by that of a conventional cooling system. According to FIG. 2, when the flow ratio falls in a range of from a finite number, being more than zero, to 0.3, the normalized values of the cooling capacity is larger than 1. In particular, when the flow ratio falls in a range of from 0.1 to 0.15, the cooling capacities are improved remarkably. However, note that, when the flow ratio is more than 0.3, the cooling capacities are lowered gradually because the temperature difference was enlarged between the second refrigerant which flows from the counterflow heat exchanger 29 to the inlet port of the pressure delivering means 20, and the second refrigerant which flows from the outlet port of the pressure delivering means 20 to the counterflow heat exchanger 29.

Second Preferred Embodiment

Figure 3:
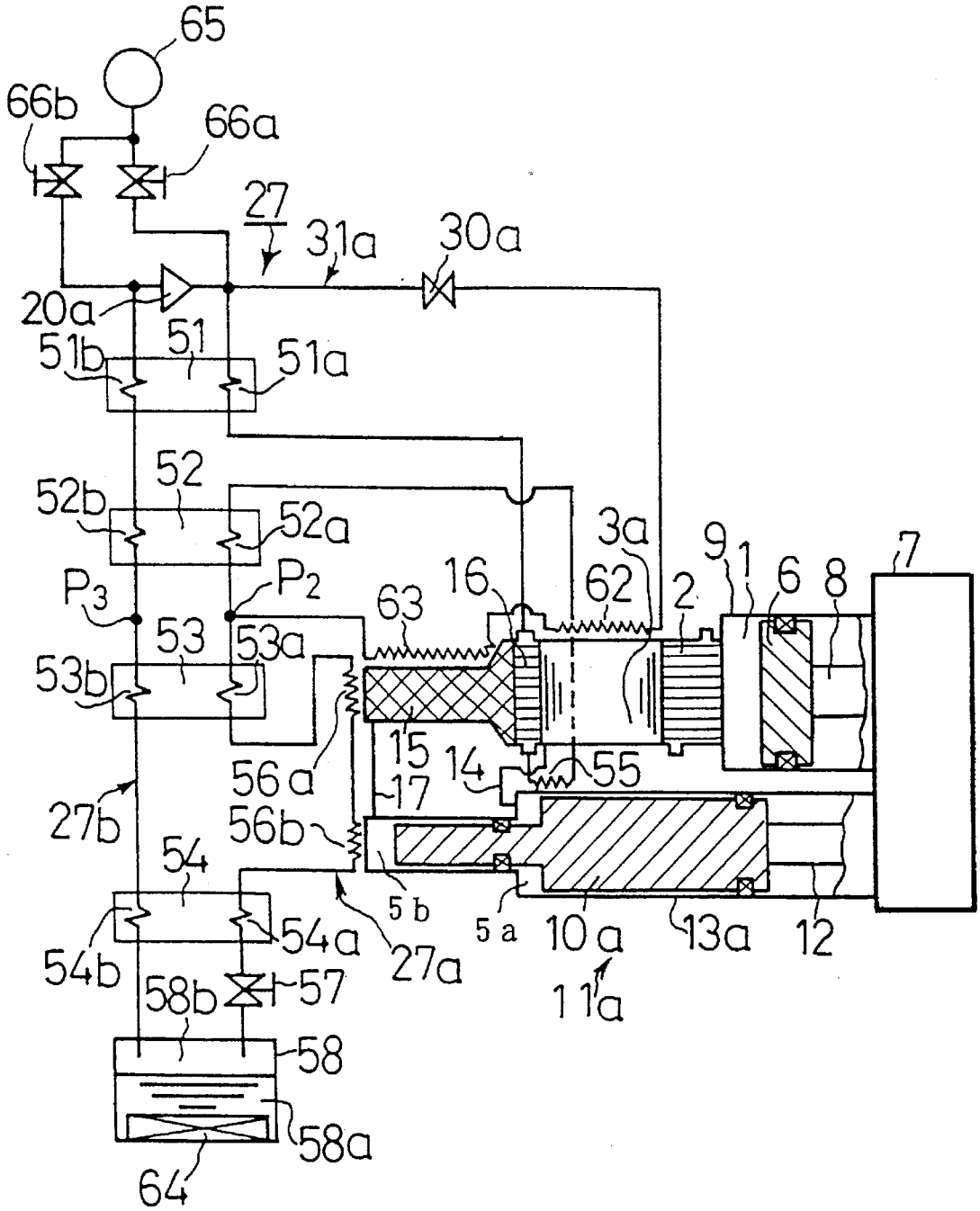
FIG. 3 is a circuit diagram of a Second Preferred Embodiment of a cooling system which embodies the second aspect of the present invention.

A Second Preferred Embodiment is an application of a J-T circuit to the cooling circuit 27 of the First Preferred Embodiment (e.g., the first aspect of the present invention), and embodies the second aspect of the present invention. FIG. 3 illustrates the Second Preferred Embodiment.

As illustrated in FIG. 3, in the Second Preferred Embodiment, a refrigerator 11*a* is employed whose expansion cylinder 13*a* is constructed in two-stage; namely: the expansion cylinder 13*a* has a first expansion chamber 5*a* and a second expansion chamber 5*b*. In order to correspond with this two-stage construction, a piston 10*a* is also constructed in two-stage, a first regenerator 3*a* and a second regenerator 15 are laminated on a chiller 2 in two-stage. Note that, however, there is disposed a pre-cooling heat exchanger 16 between the first and second accumulators 3*a*, 15.

A J-T circuit is capable of producing cold as low as a liquefied helium temperature, and cooling a substance 64, such as a superconducting magnet, to be cooled. It can be applied to an apparatus for producing liquefied helium.

The substance 64 to be cooled is immersed in a liquid reservoir 58. Liquefied helium is produced by a Joule- Thomson valve 57, and discharged out of a discharge port thereof. The liquefied helium is then passed through low-pressure-side passages 54*b* through 51*b*, which are disposed in counterflow heat exchangers 54 through 51 in a low-pressure-side circuit 27*b*, in this order. Then, part of the liquefied helium is returned to a tank 65, and the other part thereof is sucked into pressure delivering means 20*a*. The tank 65 is adapted for holding the second refrigerant (i.e., liquefied helium), and is provided with automatic opening-closing valves 66*a*, 66*b*. The automatic opening-closing valve 66*b* is opened when the second refrigerant is insufficient in the main circuit. The automatic opening-closing valve 66*a* is opened when the second refrigerant is excessive in the main circuit. However, note that the Second Preferred Embodiment can do away with the liquid reservoir 58 for cooling the substance 64 to be cooled, and that, similarly to the First Preferred Embodiment, it can employ a cooling heat exchanger which is thermally brought into contact with the substance 64 to be cooled.

The pressure delivering means 20*a* divide a helium gas into a high-pressure-side passage 51*a* (i.e., the high-pressure-side circuit according to the second aspect of the present invention), and a branched circuit 31*a*. The high-pressure-side passage 51*a* is disposed in a counterflow heat exchanger 51 (e.g., one of the first heat exchangers). The branched circuit 31*a* is provided with a throttle 30*a*, and first and second distributor heat exchangers 62, 63. The part of the helium delivered via the high-pressure-side passage 51*a*, which is disposed in the counterflow heat exchanger 51 (e.g., one of the first heat exchangers) is flowed into a high-pressure-side passage 52*a*, which is disposed in a counterflow heat exchanger 52 (e.g., one of the first heat exchangers), by way of the pre-cooling heat exchanger 16 and a pre-cooling heat exchanger 55 in this order. Note that the pre-cooling heat exchanger 55 is thermally brought into contact with the first expansion chamber 6. Further, the part of the helium gas is flowed into a high-pressure-side passage 54*a* (i.e., the high-pressure-side circuit according to the second aspect of the present invention), which is disposed in a second counterflow heat exchanger 54, by way of pre-cooling heat exchangers 56*a*, 56*b*. Note that the pre-cooling heat exchangers 56*a*, 56*b* are thermally brought into contact with a low temperature end of a chiller 15 and the second expanding chamber 5*b*, respectively.

The other part of the helium gas is flowed into the branched circuit 31*a*. Then, it is joined with the second refrigerant flowing only in the main circuit when it is lead to a joining point $P_2$ (e.g., a connecting point which is placed between the high-pressure-side passage 52*a*, disposed in the counterflow heat exchanger 52, and the high-pressure-side passage 53*a*, disposed in the counterflow heat exchanger 53). Note that, in this Second Preferred Embodiment as well, the branched circuit 31*a* can be joined with a joining point $P_3$ which is placed between the low-pressure-side passage 52*b*, disposed in the counterflow heat exchanger 52, and the low-pressure-side passage 53*b*, disposed in the counterflow heat exchanger 53.

In the thus constructed cooling system of the Second Preferred Embodiment, the refrigerator 11*a* operates in the same manner as the refrigerator 11 of the First Preferred Embodiment; namely: the refrigerator 11*a* reciprocates the first refrigerant between the first and second regenerators 15, 3*a*, and produces cold in the first and second expansion chambers 5*a*, 5*b*. The temperature of the cold produced in the second expansion chamber 5*b* is lower than that of the cold produced in the first expansion chamber 5*a*.

The helium gas compressed by the pressure delivering means 20*a* is then flowed into the main circuit and the branched circuit 31*a*. Hence, similarly to the operations of the First Preferred Embodiment, the second refrigerant (i.e., the helium gas) is synergetically cooled by the two cooling actions. One of the cooling actions results from the flow difference between the high-pressure-side passage 51*a* and the low-pressure-side passage 51*b* which are disposed in the counterflow heat exchanger 51 (e.g., one of the first heat exchangers), and the other one of the cooling actions stems from the thermal contact between the second refrigerant and the first refrigerant flowing in the distributor heat exchangers 62, 63. Thus, the second refrigerant flowing into the J-T valve 57 is cooled to a much lower temperature than it is cooled by conventional cooling systems which are not provided with the branched circuit 31*a*.

As a result, when the second refrigerant is flowed through the J-T valve 57, it is subjected to expansion (constant-enthalpy expansion) which is associated with a pressure difference from a high pressure to a low pressure, and accordingly it is liquefied at a greater yield than that of conventional cooling systems. Hence, the Second Preferred Embodiment of the present cooling system is remarkably improved in terms of cooling capability.

Generally speaking, in a liquefying apparatus, the substance 64 to be cooled can be done away with. Accordingly, the flow of the helium gas flowing into the liquid reservoir 58 is larger than the helium gas flowing out of the liquid reservoir 58 by the amount of the liquefied helium gas held in the liquid reservoir 58. In conventional liquefying apparatuses, the flow of the second refrigerant flowing in the high-pressure-side circuit 27*a* is thus greater than the flow of the second refrigerant flowing in the low-pressure-side circuit 27*b* by the amount of the liquefied second refrigerant.

On the other hand, in the Second Preferred Embodiment of the present cooling system, the flow of the second refrigerant flowing in the high-pressure-side passages 51*a*, 52*a*, which are disposed in the counterflow heat exchangers 51, 52, is smaller than the flow of the second refrigerant flowing in in the low-pressure-side passages 51*b*, 52*b*, which are disposed in the counterflow heat exchangers 51, 52, by the flow of the second refrigerant branched to flow through the throttle 30*a*. Consequently, the Second Preferred Embodiment cools the second refrigerant (i.e., the helium gas) to a lower temperature than conventional liquefying apparatuses do. In addition, although the flow of the second refrigerant flowing in the high-pressure-side passage 53*a*, which is disposed in the counterflow heat exchanger 53, is equal to the flow of the second refrigerant flowing in the high-pressure-side passage 54*a*, which is disposed in the counterflow heat exchanger 54, the former flow of the second refrigerant is cooled by the regenerators 3*a*, 15 when it flows in the distributor heat exchangers 62, 63. By this extra cooling operation, when the second refrigerant flows in the high-pressure-side passages 53*a*, 54*a*, which are disposed in the counterflow heat exchangers 53, 54, the temperature of the second refrigerant is further lowered with respect to the temperature thereof in conventional liquefying apparatuses.

All in all, in the Second Preferred Embodiment of the present cooling system, the temperature of the helium gas (i.e., the second refrigerant) flowing into the J-T valve 75 is lower compared with that obtained by conventional cooling systems. Thus, the J-T valve 75 can liquefy the helium gas in an enlarged yield. Hence, the Second Preferred Embodiment is upgraded in terms of liquefying capability.

The Second Preferred Embodiment of the present cooling system can be utilized as a pre-cooling system which is disposed prior to supplying liquefied helium onto superconducting magnets, and which cools a helium gas to a temperature of from 30 to 40K.

Modified Versions of the First and Second Preferred Embodiments

The present invention has been described so far with reference to the above-described preferred embodiments. Note that, however, the first and second aspects of the present invention are not limited to the First and Second Preferred Embodiments. The pre-cooling heat exchangers and/or the counterflow heat exchangers disposed at the specific positions can be removed as desired in order to simplify the construction of the present cooling system, or they can be added as desired in order to further enhance the cooling efficiency thereof.

Further, the refrigerator can be employed which is constructed for three-stage expansion or more.

Figure 4:
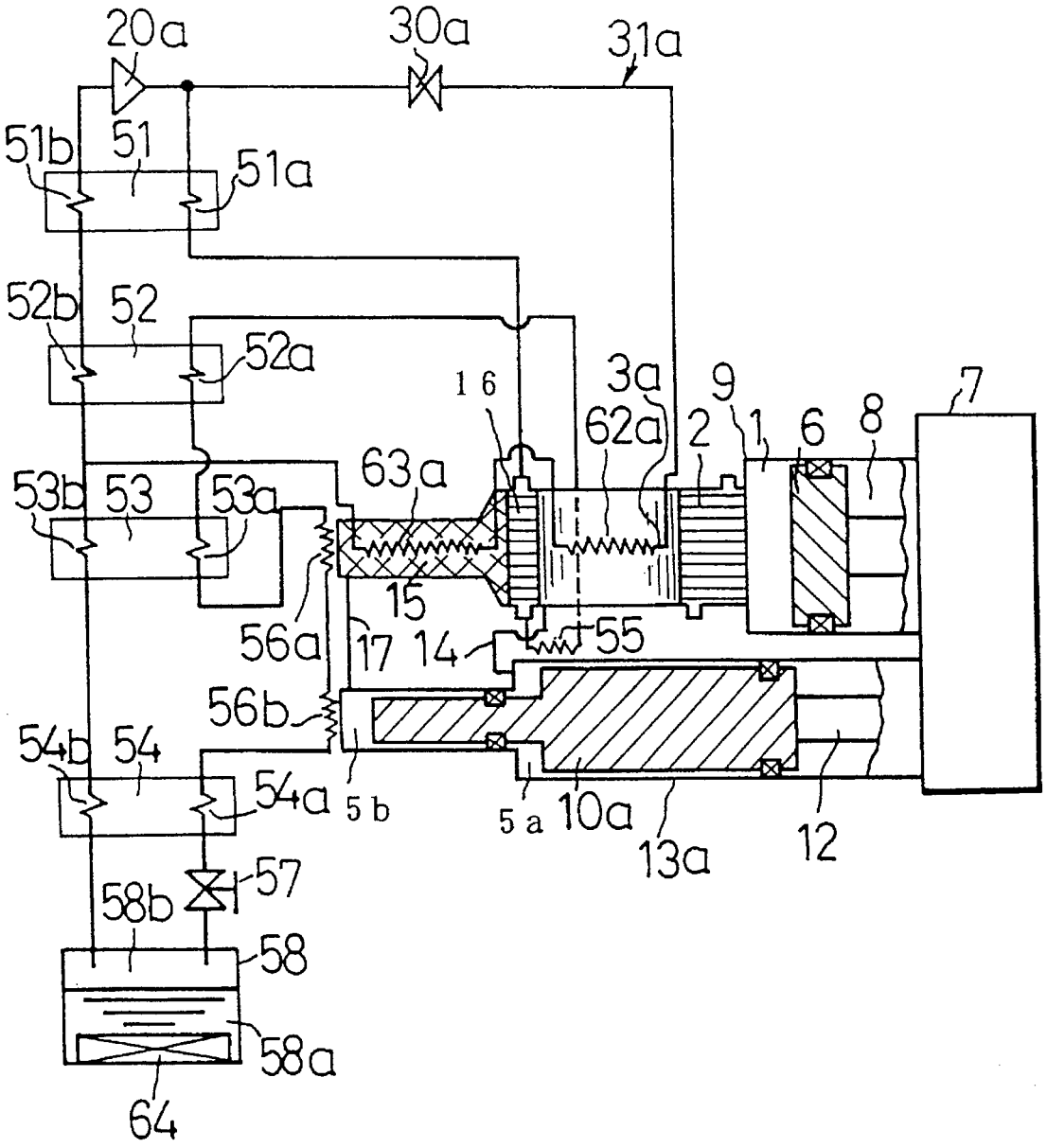
FIG. 4 is a circuit diagram of a modified version of the First and Second Preferred Embodiments which also embodies the first and second aspects of the present invention.
Figure 5:
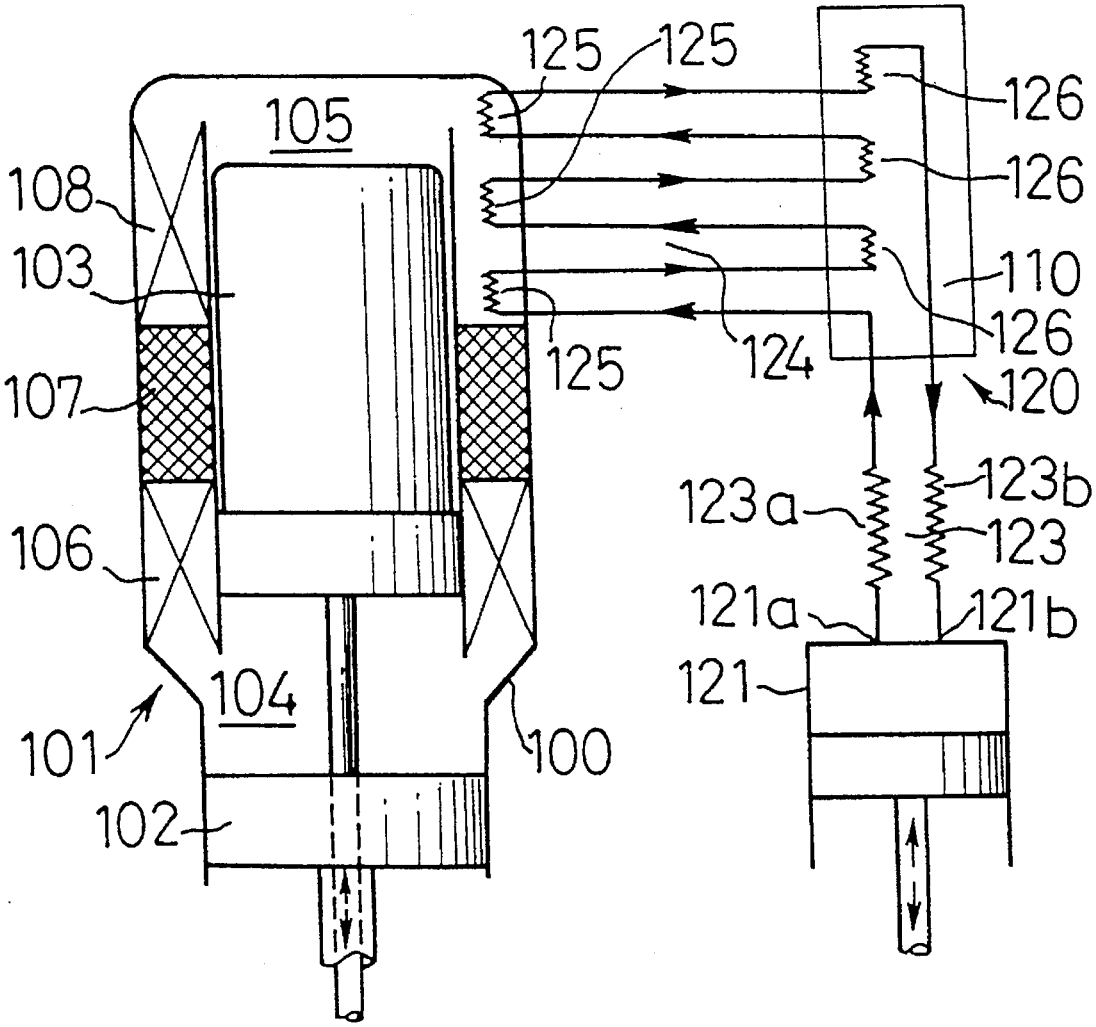
FIG. 5 is a diagram for illustrating a cooling system in which a conventional cold-accumulating refrigerator is employed.

Furthermore, as illustrated in FIG. 4, the distributor heat exchangers 62*a*, 63*a* working as the cold-conducting heat exchanger can be disposed within the regenerators 3*a*, 15, respectively. Note that this arrangement (e.g., the distributor heat exchangers 62*a*, 63*a* disposed within the regenerators 3*a*, 15) can be applied to the First Preferred Embodiment of the present cooling system as well.

Moreover, the throttle 30 or 30*a* can be a flow control valve which can be controlled manually or by electric signals. It can be disposed anywhere as far as it is disposed in the branched circuit 31 or 31*a*. In addition, the throttle 30 or 30*a* can be done away with when the cross-sectional area of the flow passage is designed appropriately in the branched circuit 31 or 31*a*.

Having now fully described the present invention, it will be apparent to one of ordinary skill in the art that many changes and modifications can be made thereto without departing from the spirit or scope of the present invention as set forth herein including the appended claims.

What is claimed is:

1. A cooling system, comprising:

a cold-accumulating refrigerator including:

a compression chamber in which a first refrigerant is compressed;

a chiller for dissipating heat resulting from the compression of the first refrigerant;

a regenerator communicating with the chiller; and an expansion chamber in which the first refrigerant, transferred via the regenerator, is expanded; and a cooling circuit in which a second refrigerant flows, the cooling circuit including a main circuit and a branched circuit:

the main circuit including:

pressure delivering means having an inlet port and an outlet port;

a heat exchanger for cooling a substance to be cooled;

a high-pressure-side circuit connecting the outlet port of the pressure delivering means and the cooling heat exchanger;

a low-pressure-side circuit connecting the cooling heat exchanger and the inlet port of the pressure delivering means; and a counterflow heat exchanger for thermally bringing the second refrigerant, flowing in the high-pressure-side circuit, into contact with the second refrigerant, flowing in the low-pressure-side circuit; and the branched circuit for branching part of the second refrigerant from an upstream portion, which is placed between the pressure delivering means and the counterflow heat exchanger in the high-pressure-side circuit of the main circuit, and introducing the part of the second refrigerant into a downstream portion, which is placed between the counterflow heat exchanger and the heat exchanger in at least one of the high-pressure-side circuit and the low-pressure-side circuit of the main circuit, the branched circuit including:

a heat exchanger for conducting cold, the cold-conducting heat exchanger being thermally brought into contact with a portion of the regenerator of said cold-accumulating refrigerator whose temperature is varied from a high temperature to a low temperature by the first refrigerant flowing therein.

2. A cooling system, comprising:

a cold-accumulating refrigerator including:

a compression chamber in which a first refrigerant is compressed;

a chiller for dissipating heat resulting from the compression of the first refrigerant;

a regenerator communicating with the chiller; and an expansion chamber in which the first refrigerant, transferred via the regenerator, is expanded; and a cooling circuit in which a second refrigerant flows, the cooling circuit including a main circuit and a branched circuit:

the main circuit including:

pressure delivering means having an inlet port and an outlet port;

cooling means for cooling a substance to be cooled;

a high-pressure-side circuit connecting the outlet port of the pressure delivering means and the cooling means;

a low-pressure-side circuit connecting the cooling means and the inlet port of the pressure delivering means;

a first counterflow heat exchanger for thermally bringing the second refrigerant, flowing in the high-pressure-side circuit, into contact with the second refrigerant, flowing in the low-pressure-side circuit;

a second counterflow heat exchanger for thermally bringing the second refrigerant, flowing in the high-pressure-side circuit downstream with respect to the first counterflow heat exchanger, into contact with the second refrigerant, flowing in the low-pressure-side circuit upstream with respect to the first counterflow heat exchanger; and a Joule-Thomson valve disposed between the second counterflow heat exchanger and the cooling means in a boundary between the high-pressure-side circuit and the low-pressure-side circuit; and the branched circuit for branching part of the second refrigerant from an upstream portion, which is placed between the pressure delivering means and the first counterflow heat exchanger in the high-pressure-side circuit of the main circuit, and introducing the part of the second refrigerant into a downstream portion, which is placed between the first counterflow heat exchanger and the cooling means in at least one of the high-pressure-side circuit and the low-pressure-side circuit of the main circuit, the branched circuit including:

a heat exchanger for conducting cold, the cold-conducting heat exchanger being thermally brought into contact with a portion of the regenerator of said cold-accumulating refrigerator whose temperature is varied from a high temperature to a low temperature by the first refrigerant flowing therein.

3. The cooling system according to claim 1 or 2, wherein a flow ratio of the part of the second refrigerant, branching from the upstream portion of the high-pressure-side circuit, with respect to the rest of the second refrigerant, flowing only in the main circuit, is set so as to fall in a range of from a finite number, being more than zero, to 0.3.

4. The cooling system according to claim 3, wherein the flow ratio is set so as to fall in a range of from 0.1 to 0.15.

5. The cooling system according to claim 1 or 2, wherein the cold-conducting heat exchanger in the branched circuit of said cooling circuit is disposed within the regenerator of said cold-accumulator.

6. The cooling system according to claim 1 or 2, wherein said cooling circuit further includes a second heat exchanger for conducting cold, the second heat exchanger being thermally brought into contact with a low temperature end of the regenerator of said cold-accumulating refrigerator.

7. The cooling system according to claim 6, wherein said cooling circuit further includes a third heat exchanger for conducting cold, the third heat exchanger being thermally brought into contact with a low temperature end of the expansion chamber of said cold-accumulating refrigerator.

8. The cooling system according to claim 1, wherein the counterflow heat exchanger in the main circuit of said cooling circuit includes a plurality of counterflow heat exchangers.

9. The cooling system according to claim 8, wherein the downstream portion is placed between a counterflow heat exchanger, which is disposed the most adjacently to the cooling heat exchanger, and another counterflow heat exchanger, which is disposed the second most adjacently to the cooling heat exchanger.

10. The cooling system according to claim 2, wherein the first counterflow heat exchanger in the main circuit of said cooling circuit includes a plurality of counterflow heat exchangers.

11. The cooling system according to claim 10, wherein the downstream portion is placed between one of the first counterflow heat exchangers, which is disposed the most adjacently to the second counterflow heat exchanger, and the second counterflow heat exchanger.

12. The cooling system according to claim 1 or 2, wherein the regenerator of said cold-accumulating refrigerator is constructed in multi-stage so that it includes a plurality of regenerators, and the heat exchanger in the branched circuit of said cooling circuit is thermally brought into contact with at least one of the regenerators.

13. The cooling system according to claim 12, wherein the heat exchanger includes a plurality of heat exchangers which are thermally brought into contact with all of the regenerators.

* * * * *